US011759398B2

(12) United States Patent
Okaki et al.

(10) Patent No.: US 11,759,398 B2
(45) Date of Patent: Sep. 19, 2023

(54) MEDICINE CASE AND MEDICINE SUPPLY DEVICE

(71) Applicant: PHC HOLDINGS CORPORATION, Tokyo (JP)

(72) Inventors: Kohei Okaki, Saitama (JP); Toshiaki Ueta, Tokushima (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 95 days.

(21) Appl. No.: 17/404,612

(22) Filed: Aug. 17, 2021

(65) Prior Publication Data

US 2021/0369569 A1 Dec. 2, 2021

Related U.S. Application Data

(63) Continuation of application No. PCT/JP2020/001358, filed on Jan. 16, 2020.

(30) Foreign Application Priority Data

Feb. 21, 2019 (JP) ..... 2019-029743

(51) Int. Cl.
*A61J 7/00* (2006.01)
*A61J 1/03* (2023.01)
*B65B 1/30* (2006.01)

(52) U.S. Cl.
CPC ..... *A61J 7/0076* (2013.01); *A61J 1/03* (2013.01); *B65B 1/30* (2013.01)

(58) Field of Classification Search
CPC ... A61J 3/00; A61J 7/0076; A61J 1/03; B65D 83/0409; B65D 1/30
(Continued)

(56) References Cited

U.S. PATENT DOCUMENTS 3,741,703 A * 6/1973 Reynolds ..... B29B 9/00 425/222
4,588,366 A * 5/1986 Glatt ..... B01J 2/16 264/117
(Continued)

FOREIGN PATENT DOCUMENTS

EP 2664316 A1 11/2013
EP 3756639 A1 * 12/2020 ..... A61J 1/03
(Continued)

OTHER PUBLICATIONS

Extended European Search Report dated Mar. 4, 2022 issued in the corresponding European Patent Application No. 20760129.5.

*Primary Examiner* — Rakesh Kumar
(74) *Attorney, Agent, or Firm* — McDermott Will & Emery LLP

(57) ABSTRACT

This medicine case comprises: a case body for accommodating a medicine, the case body being such that a discharge opening for the medicine is provided in a bottom part thereof; and a rotating member disposed inside the case body, the rotating member rotating about a rotating shaft. The rotating member has a first side wall member and a second side wall member that are parallel to each other and that constitute a passage through which the medicine is guided to the discharge opening. The first side wall member and the second side wall member approach and separate from each other while remaining parallel to each other, adjusting the width of the passage.

9 Claims, 6 Drawing Sheets

(58) Field of Classification Search
USPC ..... 221/187, 204
See application file for complete search history.

(56) References Cited

U.S. PATENT DOCUMENTS

| | | | | | |
|---|---|---|---|---|---|
| 4,946,359 | A * | 8/1990 | Christen | B01J 2/10 | 425/222 |
| 5,026,709 | A * | 6/1991 | Harwood | A61J 3/005 | 514/263.34 |
| 6,394,308 | B1 * | 5/2002 | Yuyama | B65B 35/08 | 221/121 |
| 6,786,356 | B2 * | 9/2004 | Geiger | A47J 31/60 | 99/290 |
| 7,857,162 | B2 * | 12/2010 | Minami | B65G 47/1457 | 221/168 |
| 8,430,269 | B2 * | 4/2013 | Nam | B65B 35/08 | 221/265 |
| 9,238,545 | B2 * | 1/2016 | Bae | G07F 11/44 | |
| 2011/0163112 | A1 * | 7/2011 | Takahama | G07F 17/0092 | 221/277 |
| 2013/0284755 | A1 * | 10/2013 | Yuyama | B65G 47/1464 | 221/277 |
| 2016/0371916 | A1 * | 12/2016 | Omura | G07F 17/0092 | |
| 2018/0161247 | A1 | 6/2018 | Koike et al. | | |

FOREIGN PATENT DOCUMENTS

| | | | | | |
|---|---|---|---|---|---|
| EP | 4104809 | A1 * | 12/2022 | A61J 7/0076 | |
| JP | 08164904 | A * | 6/1996 | B65B 1/30 | |
| JP | H08-164904 | A | 6/1996 | | |
| JP | 2021137151 | A * | 9/2021 | A61J 1/03 | |
| JP | 2021142014 | A * | 9/2021 | A61J 3/00 | |
| WO | WO-2017164196 | A1 * | 9/2017 | A61J 3/00 | |
| WO | WO-2020122074 | A1 * | 6/2020 | A61J 3/00 | |
| WO | WO-2021177428 | A1 * | 9/2021 | A61J 3/00 | |

* cited by examiner

MEDICINE CASE AND MEDICINE SUPPLY DEVICE

CROSS-REFERENCE OF RELATED APPLICATIONS

This application is a Continuation of International Patent Application No. PCT/JP2020/001358, filed on Jan. 16, 2020, which in turn claims the benefit of Japanese Application No. 2019-029743, filed on Feb. 21, 2019, the entire disclosures of which Applications are incorporated by reference herein.

TECHNICAL FIELD

The present invention relates to a medicine case that accommodates and discharges a medicine such as a tablet, and a medicine supply device including the medicine case.

BACKGROUND ART

In the related art, a medicine supply device including one or a plurality of medicine cases has been used. In such a medicine supply device, medicines such as tablets or capsules are sorted for each kind and are accommodated in the medicine case(s). In order to discharge a desired amount, that is, a desired number of medicines from the medicine case(s), it is necessary to discharge the medicines one by one. Further, the size and shape of the medicines vary depending on the medicines.

Patent Literature (hereinafter, referred to as "PTL") 1 discloses a medicine case that makes it possible to replace a cylindrical body, which forms a medicine discharger, in accordance with the size and shape of medicines in order to discharge the medicines one by one.

CITATION LIST

Patent Literature

PTL 1
Japanese Patent Application Laid-Open No. H08-164904

SUMMARY OF INVENTION

Technical Problem

In practice, however, it is not easy to prepare cylindrical bodies for each kind of medicines since there are an extremely large number of medicines and further new medicines are released one after another. In addition, space in a pharmacy or the like where the medicine supply device is used is wasted by keeping cylindrical bodies that are not in use.

An object of the present invention is to provide a medicine case capable of handling various kinds of medicines even without replacing members.

Solution to Problem

A medicine case according to the present invention includes: a case body that accommodates a medicine; and a rotating member disposed inside the case body. The case body includes a bottom part in which a discharge port for the medicine is provided. The rotating member rotates about a rotating shaft. The rotating member includes a first side wall member and a second side wall member that are parallel to each other and that form a passage through which the medicine is guided to the discharge port. The first side wall member and the second side wall member approach and separate from each other while being maintained parallel to each other and thus adjust a width of the passage.

Advantageous Effects of Invention

According to the present invention, it is possible to provide a medicine case capable of handling various kinds of medicines even without replacing members.

DESCRIPTION OF EMBODIMENTS

Hereinafter, a medicine case according to an embodiment of the present invention will be described with reference to the accompanying drawings.

Figure 1:
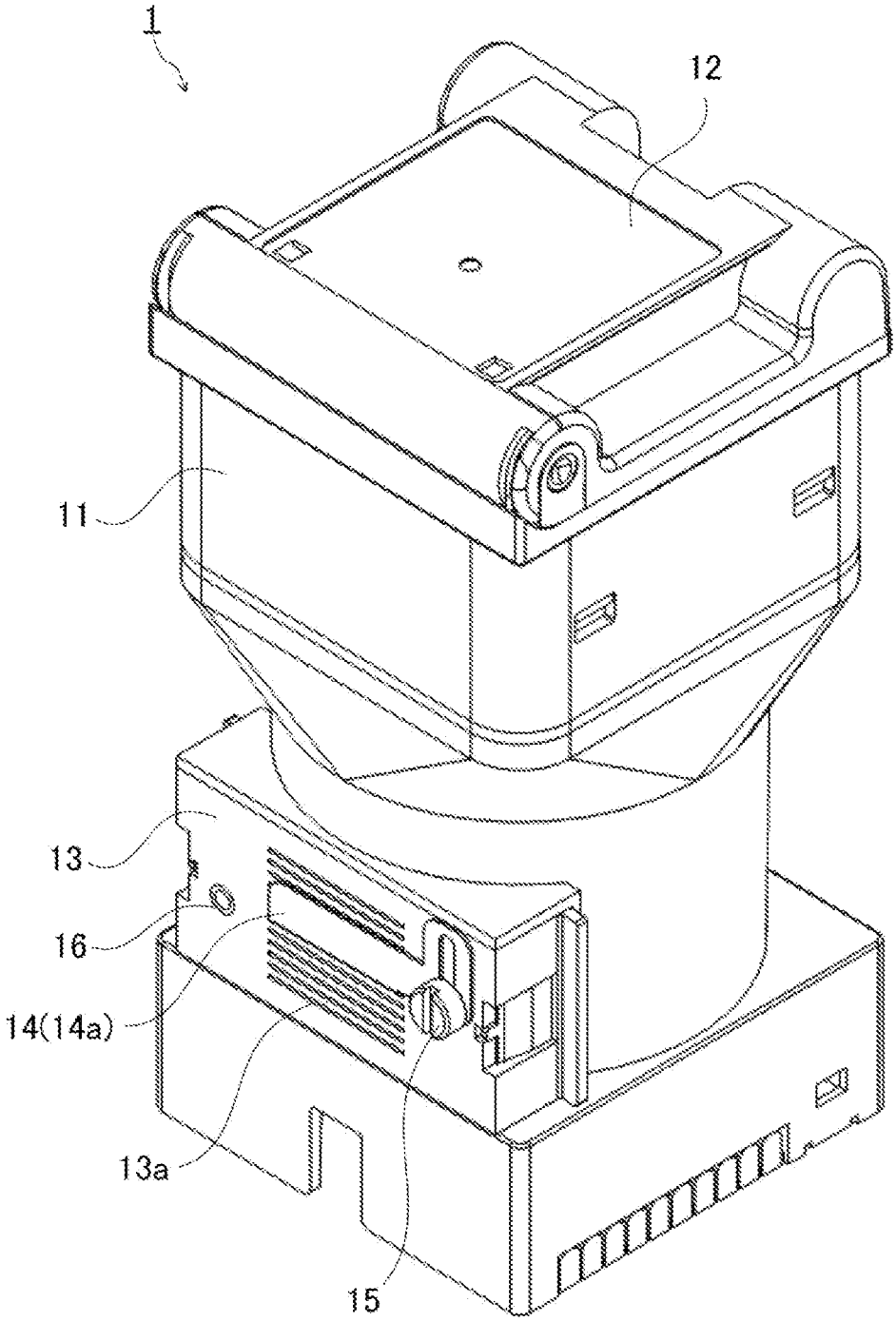
FIG. 1 is a perspective view of a medicine case according to an embodiment.

FIG. 1 is a perspective view of medicine case 1 according to the present embodiment. Medicine case 1 has an appearance formed of case body 11, lid 12, side lid 13, partition member 14, screw 15, and the like. Further, medicine case 1 includes rotating member 20 (see FIG. 3) which is not illustrated in FIG. 1. As will be described in detail later, rotating member 20 is disposed inside case body 11.

Case body 11 accommodates a medicine. Case body 11 includes an upper part in which an upper-part opening (not illustrated) serving as an inlet for a medicine is provided. Lid 12 is attached to the upper part of case body 11 via a hinge or the like. Lid 12 opens and closes the upper-part opening of case body 11.

Further, case body 11 includes a side part in which a side-part opening (not illustrated) is provided and to which side lid 13 is attached so as to cover the side-part opening. In side lid 13, a plurality of partition member insertion ports 13*a* each extending thinly in the horizontal direction is provided so as to be aligned vertically.

Partition member 14 is attached to side lid 13. Partition member 14 is fixed by screw 15 that is screwed into screw hole 16 formed in side lid 13. Partition member 14 is a plate member having an L-shaped cross section, and includes inner-side plate 14*b* (see FIG. 2) which is orthogonal to outer-side plate 14*a* disposed in an outer part of side lid 13, and which is inserted into case body 11 through partition member insertion port 13*a* and the side-part opening.

Note that, a total of two screw holes 16 are formed in side lid 13, with one screw holes 16 near the left end of side lid 13 and one screw hole 16 near the right end of side lid 13. Further, outer-side plate 14*a* is a plate which has an L-shape and which is formed of a part extending in the horizontal direction and a part extending in the vertical direction. Further, an elongated hole extending in the vertical direction is formed in the part extending in the vertical direction. Accordingly, in a case where screw 15 is inserted into screw hole 16 on the right side though the elongated hole formed in outer-side plate 14*a* as illustrated in FIG. 1, inner-side plate 14*b* can be inserted into, of the plurality of partition member insertion ports 13*a* aligned in the vertical direction, partition member insertion port 13*a* on a lower side. On the other hand, although not illustrated, in a case where screw 15 is inserted into screw hole 16 on the left side through the elongated hole formed in outer-side plate 14*a*, inner-side plate 14*b* can be inserted into partition member insertion port 13*a* on an upper side. It goes without saying that partition member insertion port 13*a* into which inner-side plate 14*b* is inserted can be selected by adjusting a relative position between the elongated hole and screw 15.

Figure 2:
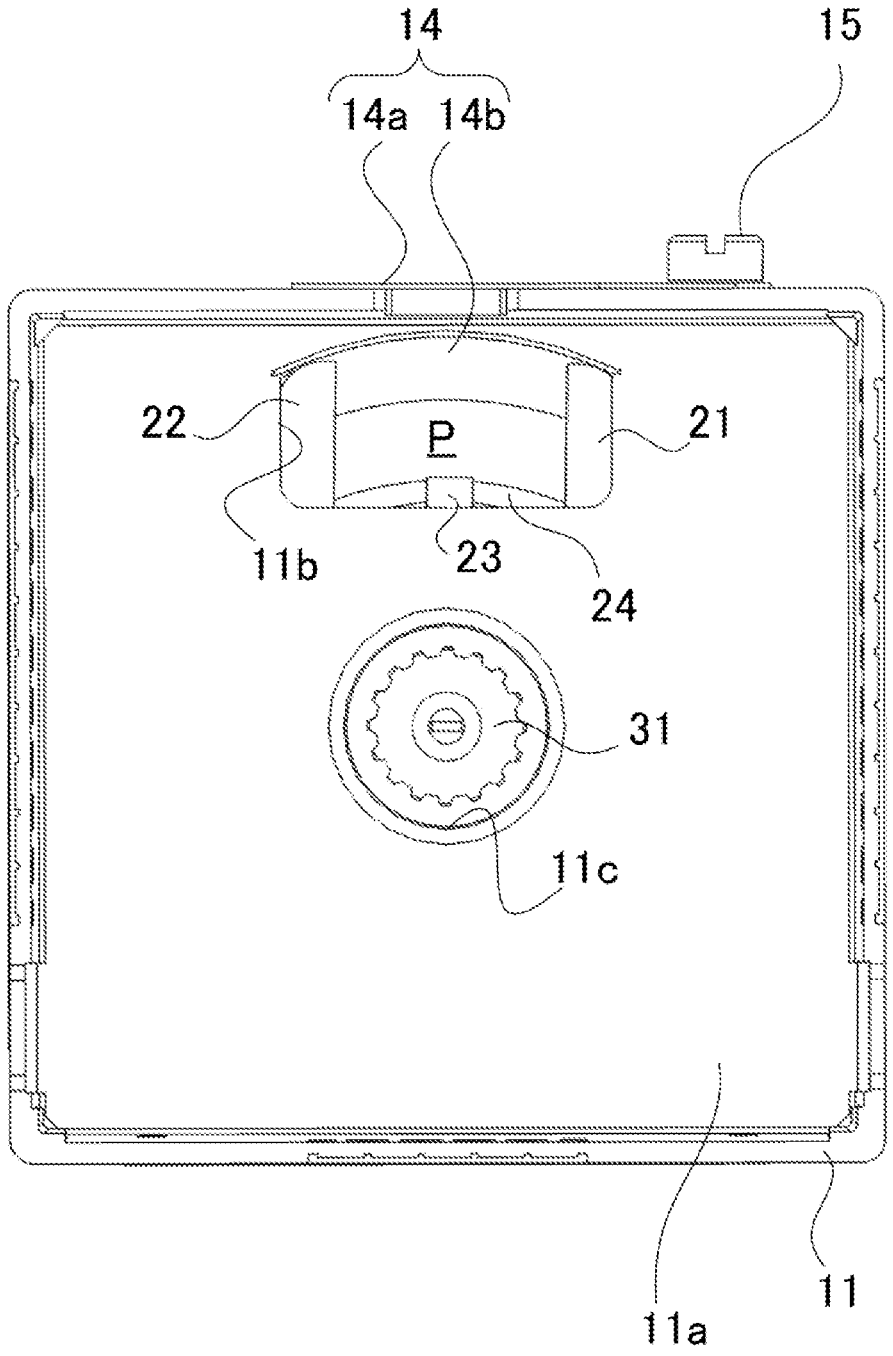
FIG. 2 is a bottom view of the medicine case according to the embodiment.

FIG. 2 is a bottom view of medicine case 1. Case body 11 includes bottom part 11*a* in which discharge port 11*b* and driving shaft insertion port 11*c* are provided. A medicine is discharged through discharge port 11*b*.

FIG. 2 indicates, through discharge port 11*b*, how it looks above discharge port 11*b*, that is, inside of case body 11. Specifically, FIG. 2 indicates passage P, first side wall member 21, second side wall member 22, third side wall member 23, and inclined plate 24. Passage P is a region through which a medicine passes from above to below inside case body 11. First side wall member 21, second side wall member 22, third side wall member 23, and inclined plate 24 are members that form passage P. Further, FIG. 2 indicates how inner-side plate 14*b*, which is a part of partition member 14, is inserted into passage P.

Further, FIG. 2 indicates how shaft 31 is disposed above driving shaft insertion port 11*c*. Shaft 31 is located at the center of rotating member 20.

Figure 3:
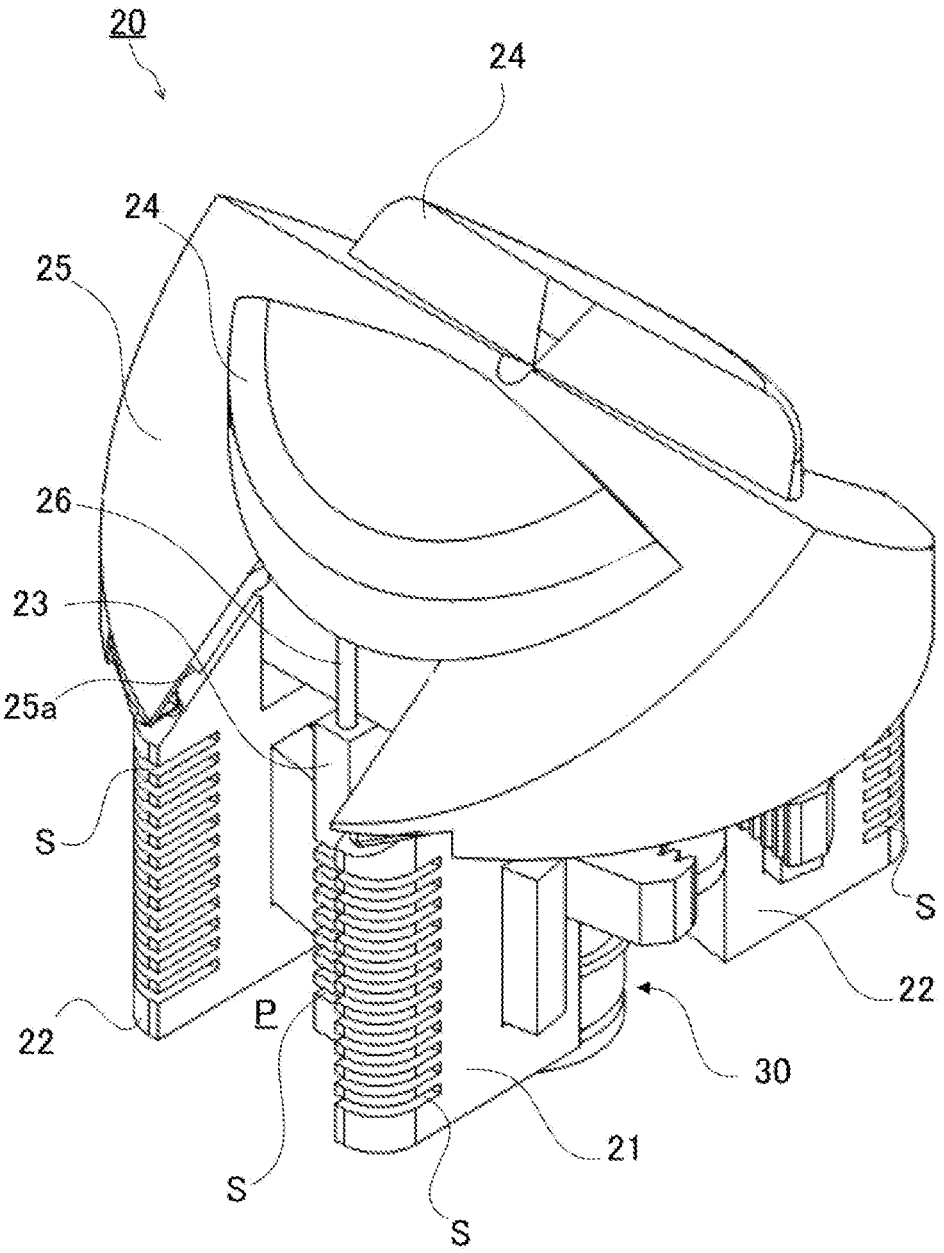
FIG. 3 is a perspective view of a rotating member included in the medicine case according to the embodiment.

FIG. 3 is a perspective view of rotating member 20 included in medicine case 1 according to the present embodiment. Rotating member 20 is a member which is disposed on bottom part 11*a*, and which rotates about its own rotating shaft by a driving shaft (not illustrated) connected to rotating member 20 through driving shaft insertion port 11*c*. Note that, the driving shaft is a member included in a medicine supply device to which medicine case 1 is attached, and is rotatably driven by a motor included in the medicine supply device.

Rotating member 20 includes base part 30, first side wall member 21, second side wall member 22, and third side wall member 23. First side wall member 21, second side wall member 22, and third side wall member 23 are disposed around base part 30. Further, rotating member 20 includes inclined plate 24, upper-part member 25, and connecting rod 26 that are disposed above base part 30. Connecting rod 26 connects third side wall member 23 and inclined plate 24.

First side wall member 21, second side wall member 22, third side wall member 23, and case body 11 or side lid 13 form passage P through which a medicine is guided to discharge port 11*b*.

Rotating member 20 includes the rotating shaft extending in the vertical direction, and has a rotationally symmetric shape about the rotating shaft. Specifically, rotating member 20 includes upper-part member 25 having a gable roof shape (inverted V-shape) symmetrical with respect to a vertical surface including the rotating shaft. Upper-part member 25 includes two notches at positions separated by 180 degrees about the rotating shaft. The notch serves as an inlet of passage P.

Further, rotating member 20 includes two of each member other than upper-part member 25 and base part 30, for example, includes two first side wall members 21. These members are arranged at positions symmetrical with the rotating shaft therebetween. Accordingly, every time rotating member 20 rotates 180 degrees about its own rotating shaft, the same members are located at the same positions. Thus, every time rotating member 20 rotates 180 degrees, passage P is located above discharge port 11*b* (see FIG. 2).

Subsequently, rotating member 20 will be described in more detail with reference to FIGS. 4, 5 and 6 in addition to FIG. 3.

Figure 4:
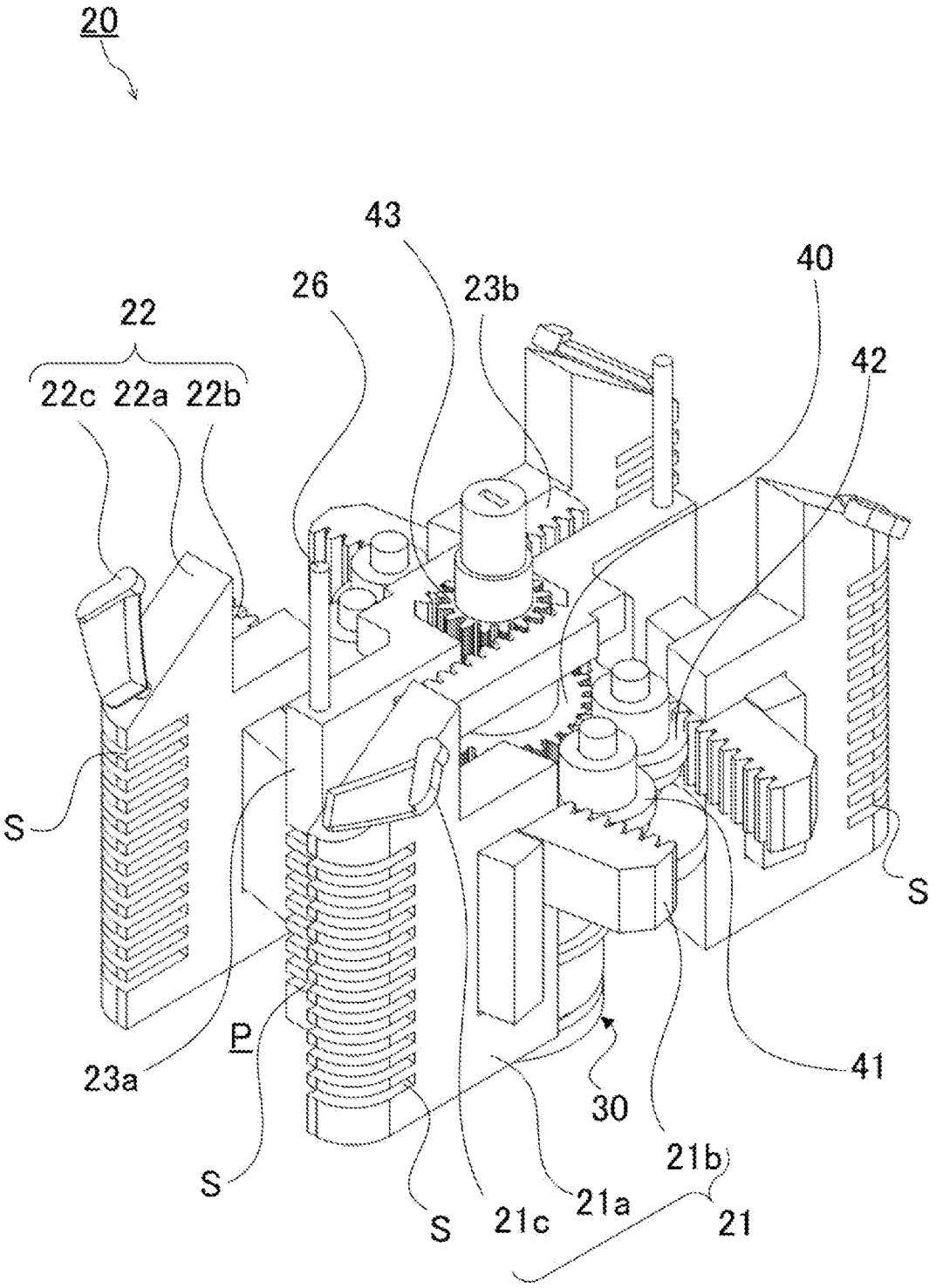
FIG. 4 is a perspective view illustrating an internal structure of the rotating member.

FIG. 4 is a perspective view illustrating an internal structure of rotating member 20. Specifically, FIG. 4 indicates a state in which inclined plates 24 and upper-part member 25 are removed from rotating member 20 illustrated in FIG. 3. FIG. 5 is a bottom view of rotating member 20. FIG. 5 also illustrates side lid 13. FIG. 5 indicates an example of medicine M with a dotted line. Further, for convenience of description, FIG. 5 does not illustrate first side wall member 21, second side wall member 22, third side wall member 23, and inclined plate 24, which are to be disposed on a lower side of FIG. 5. FIG. 6 is a longitudinal sectional view of rotating member 20. FIG. 6 also illustrates case body 11. Further, for convenience of description, FIG. 6 does not illustrate some (base part 30 and gears, which are described later) of members that form rotating member 20.

First, a description will be given of base part 30 which is one of the members that form rotating member 20.

Base part 30 includes shaft 31 coaxial with the rotating shaft of rotating member 20. A pair of branch members 32 extends from shaft 31 in a radial direction of rotating member 20 and in directions opposite to each other. A pair of side wall support members 33 extends from near a leading end of each branch member 32 in directions separating from each other.

Figure 5:
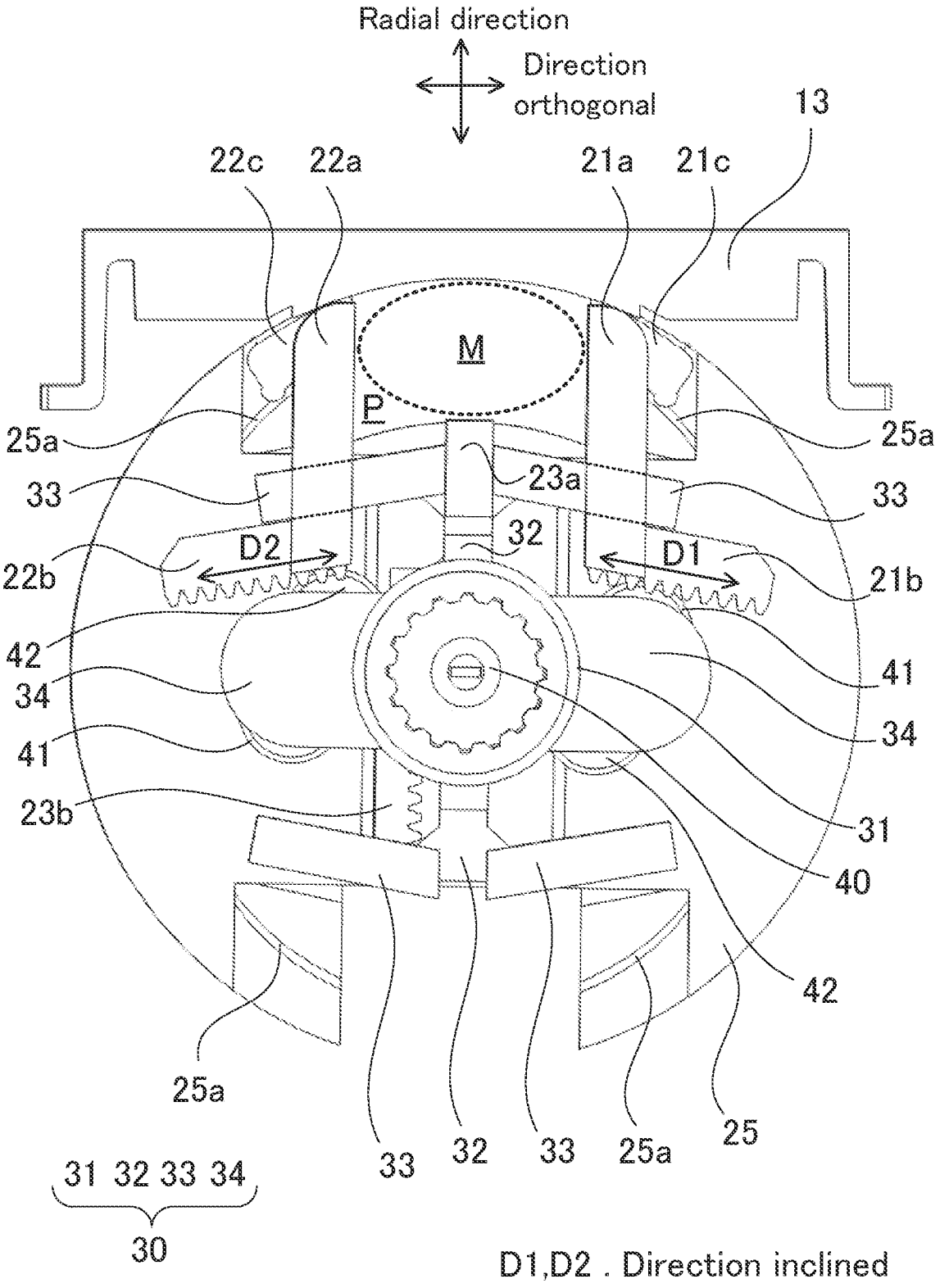
FIG. 5 is a bottom view of the rotating member.

As illustrated well in FIG. 5, an extending direction of branch member 32 and an extending direction of side wall support member 33 form an acute angle. In other words, the extending direction of one side wall support member 33 and the extending direction of another side wall support member 33, where side wall support members 33 extend from the leading end of one branch member 32, form an obtuse angle. That is, branch member 32 and the pair of side wall support members 33 have an arrow shape in a bottom view (that is, in a plan view).

Further, a pair of gear support members 34 extends from shaft 31 in the radial direction of rotating member 20, in directions orthogonal to the extending directions of branch members 32, and in directions opposite to each other.

Subsequently, a description will be given of members which form rotating member 20 and which are attached to base part 30.

First side wall member 21 and second side wall member 22 are attached to side wall support members 33. First side wall member 21 is formed of first side wall member body 21*a*, first rack 21*b*, and first fall prevention member 21*c*. Second side wall member 22 is formed of second side wall member body 22*a*, second rack 22*b*, and second fall prevention member 22*c*. Second side wall member 22 has a shape that is a mirror image of a shape of first side wall member 21. Thus, what can be said for first side wall member 21 also applies to second side wall member 22. Accordingly, hereinafter, mainly first side wall member 21 will be described, and a description of second side wall member 22 will be omitted as appropriate.

First side wall member body 21*a* is a substantially flat member, and extends in a direction parallel to the extending direction of branch member 32 (that is, one plane including the rotating shaft of rotating member 20). In first side wall member body 21*a*, a through-hole having a shape as indicated with a dotted line in FIG. 5 is formed. That is, the through-hole is formed so as to extend in a direction which is horizontal, and which is inclined with respect to a direction orthogonal to the radial direction of rotating member 20. The through-hole has a rectangular shape when viewed from one side to another side in a direction in which the through-hole extends.

Side wall support member 33 penetrates the through-hole. Side wall support member 33 is a plate-like member which has a certain thickness and which can also be said to have a rectangular parallelepiped shape. Side wall support member 33 is formed in such a shape that when side wall support member 33 penetrates the through-hole formed in first side wall member body 21*a*, almost no gap is generated between side wall support member 33 and the through-hole. Accordingly, first side wall member body 21*a* and further first side wall member 21 can slide along the extending direction of side wall support member 33 without rattling.

As will be described later, a distance between first side wall member 21 and second side wall member 22 is adjusted in accordance with a size of medicine M that is handled by medicine case 1. When medicine M becomes large and the distance between first side wall member 21 and second side wall member 22 becomes wide, first side wall member 21 and second side wall member 22 may come into contact with an inner surface of case body 11 to interfere with smooth rotation of rotating member 20. Accordingly, in medicine case 1 according to the present embodiment, the angle formed by the extending direction of branch member 32 and the extending direction of side wall support member 33 is set to be equal to or larger than 70 degrees and equal to or smaller than 85 degrees, more preferably is set to be 80 degrees. Such an angle enables first side wall member 21 and second side wall member 22 to linearly move and approach and separate from each other, without coming into contact with the inner surface of case body 11, and while being maintained parallel to each other.

Further, an outer peripheral-side end part of first side wall member body 21*a*, which is a part that does not face second side wall member body 22*a* (that is, passage P), has a round shape or is chamfered in a plan view. Accordingly, even when the distance between first side wall member 21 and second side wall member 22, that is, a width of passage P becomes large, the outer peripheral-side end part of first side wall member body 21*a* does not protrude from a circle that forms an outer periphery of upper-part member 25, that is, does not come into contact with the inner surface of case body 11. Accordingly, rotating member 20 can smoothly rotate inside case body 11 regardless of the distance between first side wall member 21 and second side wall member 22.

Further, an upper end of first side wall member body 21*a* is formed of a surface substantially parallel to an upper surface of upper-part member 25. Accordingly, even when the width of passage P becomes small and first side wall member 21 is exposed from the notch of upper-part member 25, medicine M can smoothly fall toward passage P without staying on first side wall member body 21*a*.

In an outer diameter-side end part of first side wall member body 21*a*, a plurality of slots S each extending along a horizontal surface is provided so as to be aligned vertically. The height for providing each slot S coincides with the height for providing each partition member insertion port 13*a* (see FIG. 1). Accordingly, when rotating member 20 rotates in a state in which inner-side plate 14*b* of partition member 14 is inserted into case body 11 through partition member insertion port 13*a*, inner-side plate 14*b* passes through slot S formed in first side wall member body 21*a*. Similarly, inner-side plate 14*b* also passes through slot S formed in second side wall member body 22*a*. Accordingly, rotating member 20 can continue to rotate without any trouble even when partition member 14 is attached thereto.

First rack 21*b* extends from an inner-side end part of first side wall member body 21*a* toward an outer diameter side of rotating member 20 in a direction substantially parallel to the extending direction of side wall support member 33.

First fall prevention member 21*c* is attached to the upper end of first side wall member body 21*a*. First fall prevention member 21*c* is a member for preventing a medicine from passing through a rear surface side of first side wall member body 21*a* to fall when the distance between first side wall member 21 and second side wall member 22, that is, the width of passage P becomes narrow. Note that, the rear surface side of first side wall member body 21*a* is a side facing second side wall member body 22*a*, that is, a side opposite to a side on which a surface that forms passage P is present.

First fall prevention member 21*c* includes a downwardly protruding shaft part at a position close to passage P. The shaft part is inserted into a hole formed on an upper side of first side wall member body 21*a*. Accordingly, first fall prevention member 21*c* is turnable with respect to first side wall member body 21*a* with the position close to passage P as a rotation center.

Further, as illustrated in FIGS. 3 and 5, notches are formed at positions of a lower surface of upper-part member 25, where the positions face first fall prevention member 21*c* and second fall prevention member 22*c*. The notch includes a side surface that is guide part 25*a* which comes into contact with a position of first fall prevention member 21*c* or second fall prevention member 22*c*, where the position is far from passage P, to guide first fall prevention member 21*c* or second fall prevention member 22*c*.

As illustrated well in FIG. 5, guide part 25*a* has an arc sharp. This arc, however, is not concentric with the circle that forms the outer periphery of upper-part member 25, but is closer to the circle that forms the outer periphery of upper-part member 25 as a position of the arc is closer to passage P. Accordingly, when first side wall member body 21*a* moves in a direction approaching second side wall member body 22*a*, first fall prevention member 21*c* is guided, while turning about the rotation center, so as to be pressed toward outside of rotating member 20 by guide part 25*a*. Accordingly, an outer peripheral-side part of first fall prevention member 21*c* can move along the circle that forms the outer periphery of upper-part member 25. Accordingly, even when first side wall member body 21*a* and second side wall member body 22*a* approach each other and the width of passage P becomes narrow, it is possible to prevent a gap from being formed between the outer peripheral-side part of first fall prevention member 21*c* and the inner surface of case body 11. Further, even when medicine M is small and the distance between first side wall member body 21*a* and second side wall member body 22*a* becomes narrow, it is possible to prevent medicine M, which is small, from falling from between the outer peripheral-side part of first fall prevention member 21*c* and the inner surface of case body 11.

As described above, second side wall member 22 has the shape that is the mirror image of the shape of first side wall member 21. Accordingly, first side wall member body 21*a* and second side wall member body 22*a* are parallel to each other. The relationship of these members being parallel to each other is always maintained at whatever positions first side wall member 21 and second side wall member 22 are located after slidingly moving along side wall support members 33.

Central gear 40 is disposed on shaft 31 so as to rotatable with respect to shaft 31 about the rotating shaft of rotating member 20. Central gear 40 includes a shaft part (not illustrated). The shaft part is fitted into a hole formed in shaft 31. A frictional force between the shaft part and the inner surface of the hole is relatively strong. When rotating member 20 rotates, shaft 31 and central gear 40 can rotate integrally. On the state hand, as will be described later, in a case where first side wall member 21 and second side wall member 22 are caused to approach or separate from each other, it is possible to relatively rotate shaft 31 and central gear 40 by applying relatively strong torque to central gear 40 in a state in which shaft 31 is fixed.

In addition, first gear 41 and second gear 42 are rotatably disposed on gear support members 34. Central gear 40 meshes with second gear 42. Second gear 42 meshes with first gear 41. Further, first gear 41 meshes with first rack 21*b*, and second gear 42 meshes with second rack 22*b*.

Accordingly, for example, when one of two first side wall members 21 slidingly moves along side wall support member 33, first rack 21*b* included in first side wall member 21 described above slidingly moves, and one first gear 41 rotates at the same time. Then, one second gear 42 rotates, one second rack 22*b* slidingly moves, and central gear 40 rotates. Then, second gear 42 on the opposite side rotates, and second rack 22*b* on the opposite side slidingly moves. Further, first gear 41 on the opposite side rotates, and first rack 21*b* on the opposite side slidingly moves.

That is, two first side wall members 21 and two second side wall members 22 are configured such that when any one thereof moves, the other three thereof also move at the same time. Further, a tooth pitch and a size of each gear are set such that movement amounts of two first side wall members 21 and two second side wall members 22 become equal. Accordingly, two first side wall members 21 and two second side wall members 22 move by the same distance at the same time.

Third side wall member 23 is disposed between first side wall member 21 and second side wall member 22. Third side wall member 23 includes third side wall member body 23*a*, third rack 23*b*, and guide rod 23*c* (see FIG. 6). Guide rod 23*c* (see FIG. 6) is slidably inserted into a hole which is formed in branch member 32 and which extends in a radial direction. Accordingly, third side wall member 23 is slidingly movable, that is, is capable of advancing and retracting in the radial direction of rotating member 20.

Third side wall member body 23*a* extends in the same direction as the extending direction of branch member 32 and in the vertical direction, and covers the leading end of branch member 32. An outer diameter-side end part of third side wall member body 23*a* faces passage P.

In the outer diameter-side end part of third side wall member body 23*a*, a plurality of slots S each extending along a horizontal surface is provided so as to be aligned vertically. The height for providing each slot S coincides with the height for proving each partition member insertion port 13*a* (see FIG. 1). Accordingly, when rotating member 20 rotates in a state in which third side wall member body 23*a* is located near an outer periphery of rotating member 20, inner-side plate 14*b* passes through slot S formed in third side wall member body 23*a*. Accordingly, rotating member 20 can continue to rotate regardless of positions of partition member 14 and third side wall member 23.

Third rack 23*b* extends in a direction parallel to branch member 32 from an inner-side end part of third side wall member body 23*a* via a crank.

Third gear 43 is disposed on central gear 40 so as to be rotatable, independently of central gear 40, about the rotating shaft of rotating member 20. Third gear 43 meshes with third rack 23*b*.

Accordingly, when one of two third side wall members 23 advances or retracts along branch member 32, third rack 23*b* included in third side wall member 23 described above advances or retracts and third gear 43 rotates at the same time. Then, third rack 23*b* on the opposite side advances or retracts.

That is, it is configured such that when one third side wall member 23 advances or retracts, another third side wall member 23 also advances or retracts at the same time. Further, a tooth pitch and a size of each gear are set such that movement amounts of two third side wall members 23 become equal. Accordingly, two third side wall members 23 are configured to advance or retract by the same distance at the same time.

Further, third side wall member 23 advances or retracts in conjunction with inclined plate 24 to which third side wall member 23 is connected via connecting rod 26. Specifically, when third side wall member 23 advances or retracts, inclined plate 24 advances or retracts along an inclined surface which is the upper surface of upper-part member 25, that is, along an extending direction of inclined plate 24.

Medicine case 1 configured as described above is used as follows.

A width and a depth of passage P are set in accordance with a size and a shape of medicine M that is accommodated inside case body 11.

First, a method for setting the width of passage P will be described. Note that, the width of passage P is the distance between first side wall member 21 and second side wall member 22.

As illustrated in FIG. 2, a flathead screwdriver engaging part formed in central gear 40 is visible through driving shaft insertion port 11*c* provided in bottom part 11*a* of case body 11. Central gear 40 is relatively rotated with respect to shaft 31 by engaging a flathead screwdriver with the flathead screwdriver engaging part and rotating the flathead screwdriver in a state in which shaft 31 is fixed. Then, first gear 41 and second gear 42 rotate, and first side wall member 21 and second side wall member 22 slidingly move, while being maintained parallel to each other, so as to approach or separate from each other along the direction inclined with respect to the direction orthogonal to the radial direction of rotating member 20. Such an operation makes it possible to set the width of passage P.

First side wall member 21 and second side wall member 22 approach or separate from each other while surfaces of first side wall member 21 and second side wall member 22, where the surfaces face each other, are maintained parallel to each other. Accordingly, the width of passage P is equal at whatever position in the radial direction of rotating member 20. Conversely, the shape of passage P in a plan view does not become a shape such as, for example, a fan shape whose inner side in a radial direction is narrow and whose outer side in the radial direction is wide. Accordingly, passage P has a width corresponding to a width of medicine M at whatever position, and medicine M can pass through passage P smoothly from above to below. Further, medicine M can be surely discharged every time passage P moves above discharge port 11*b* in accordance with the rotation of rotating member 20.

Further, when first side wall member 21 and second side wall member 22 approach or separate from each other, first side wall member 21 and second side wall member 22 linearly move along the horizontal direction inclined with respect to the direction orthogonal to the radial direction of rotating member 20. In other words, first side wall member 21 and second side wall member 22 approach and separate from each other without protruding from an outer shape of rotating member 20, which has a substantially circular shape. Accordingly, however the width of passage P is adjusted, first side wall member 21 and second side wall member 22 do not protrude outside a side part of rotating member 20, and rotating member 20 does not interfere with case body 11. That is, however the width of passage P is adjusted, rotating member 20 can smoothly rotate inside case body 11.

Next, a method for setting the depth of passage P will be described. Note that, the depth of passage P is a distance between third side wall member 23 and side lid 13 or case body 11.

Figure 6:
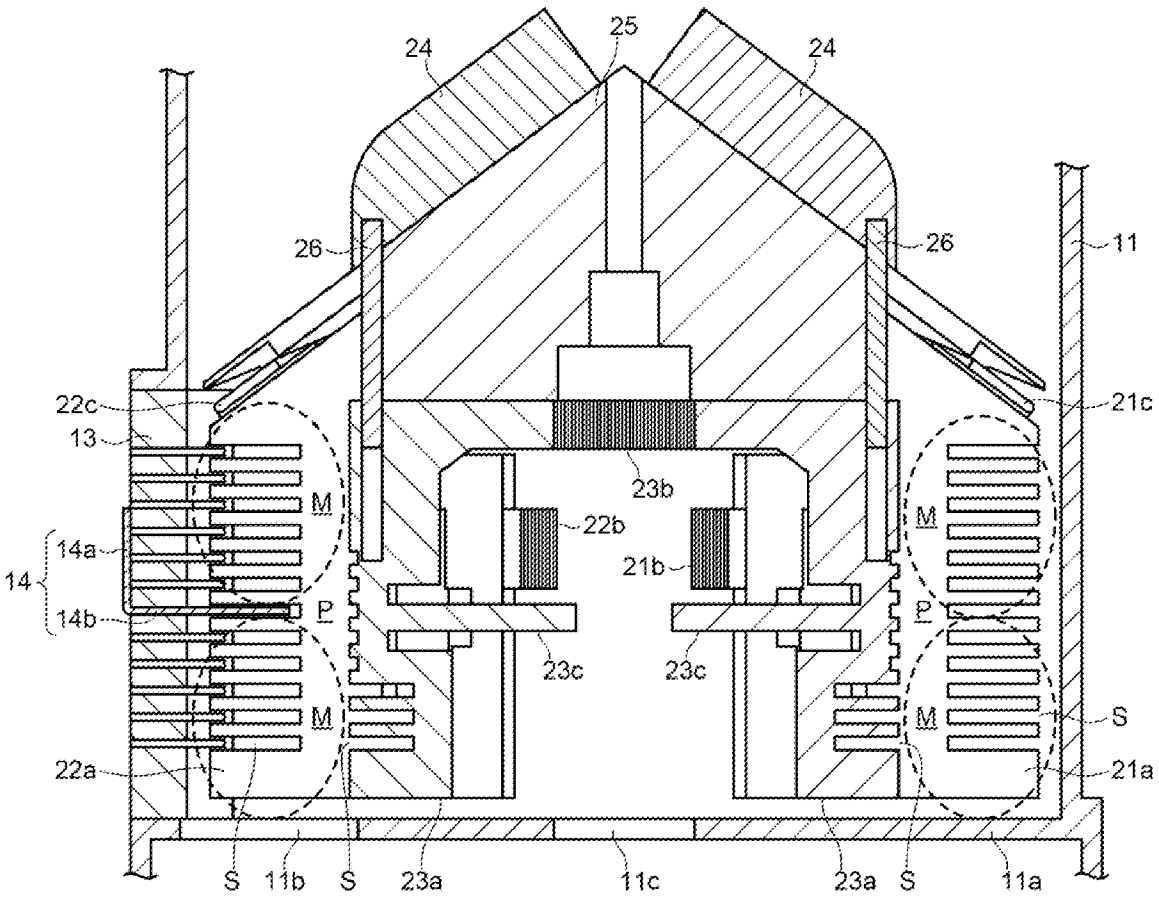
FIG. 6 is a longitudinal sectional view of the rotating member.

As illustrated in FIG. 6, a through-hole extending in the vertical direction is formed at the center of upper-part member 25. Further, as illustrated in FIG. 4, a flathead screwdriver engaging part is formed at an upper end of third gear 43. Accordingly, it is possible to rotate third gear 43 by inserting a flathead screwdriver into the through-hole formed in upper-part member 25 to engage the flathead screwdriver with the flathead screwdriver engaging part and rotating the flathead screwdriver. When third gear 43 is rotated, two third side wall members and two inclined plates 24 advance or retract in the radial direction of rotating member 20. Such an operation makes it possible to set the depth of passage P and the depth of the inlet of passage P.

Inclined plate 24 guides medicines M accommodated in case body 11 to passage P one by one. Further, inclined plate 24 has a fan shape in which an arc is located on a side of passage P. Accordingly, inclined plate 24 has a function of adjusting the orientation of medicine M to an attitude in accordance with the width of passage P. When it is described in detail, in a case where medicine M has a flat (for example, elliptical) cross-sectional shape, inclined plate 24 prevents medicine M from falling into passage P in an attitude in which a width direction (major axis direction) of medicine M coincides with the radial direction of rotating member 20. In other words, inclined plate 24 guides medicine M such that medicine M falls into passage P in an attitude in which a thickness direction (minor axis direction) of medicine M coincides with the radial direction of rotating member 20.

Further, the position of third side wall member 23, that is, the depth of passage P is adjusted in accordance with a thickness of medicine M. Accordingly, medicine M can smoothly pass through passage P from above to below without moving in a radial direction thereof within passage P. Further, medicine M can be surely discharged every time passage P moves above discharge port 11*b* in accordance with the rotation of rotating member 20.

Next, attachment of partition member 14 to be inserted into passage P will be described.

Partition member 14 is inserted into one of the plurality of partition member insertion ports 13*a* such that a distance between an upper surface of bottom part 11*a* and a lower surface of inner-side plate 14*b* becomes slightly larger than a height of medicine M that passes through passage P.

Accordingly, even when passage P is located above discharge port 11*b* in a state in which a plurality of medicines M is vertically aligned within passage P, inner-side plate 14*b* enters between medicine M, which is the lowermost, and medicine M, which is thereon so that medicines other than medicine M, which is the lowermost, cannot fall from discharge port 11*b*. In other words, medicines M can be surely discharged from discharge port 11*b* one by one by attaching partition member 14 to an appropriate position corresponding to the height of medicine M.

As described above, the width and depth of passage P are set, and numerous medicines M are accommodated in case body 11 after partition member 14 is attached. Subsequently, medicine case 1 is attached to the medicine supply device such that the driving shaft is inserted into shaft 31.

Note that, the width and depth of passage P may be adjusted by visually measuring the movement amounts of first side wall member 21, second side wall member 22, and third side wall member 23 or by using a simulated medicine. A simulated medicine is formed large at a predetermined ratio with respect to medicine M that is handled by medicine case 1 in practice. The width and depth of passage P through which medicine M can pass smoothly can be set by moving, in a state in which a simulated medicine is placed into passage P, first side wall member 21, second side wall member 22, and third side wall member 23 such that first side wall member 21, second side wall member 22, and third side wall member 23 come into contact with the simulated medicine, and by performing position determination.

Further, an adjustment width of the width of passage P (difference between a maximum value and a minimum value of the width of passage P) is larger than an adjustment width of the depth of passage P (difference between a maximum value and a minimum value of the depth of passage P). Accordingly, it is possible to adjust the width and depth of passage P in accordance with medicines M having various sizes and shapes. Further, the height of passage P (that is, the height of first side wall member body 21*a* and second side wall member body 22*a*) is larger than the maximum value of the width of passage P. That is, passage P has a sufficient height. Accordingly, it is possible to align two or more medicines M vertically within passage P, and medicines M can be surely discharged from discharge port 11*b* one by one every time passage P moves above discharge port 11*b*.

When the motor included in the medicine supply device rotates, the driving shaft rotates, and shaft 31 also rotates. Then, rotating member 20 rotates, and medicine M is guided to passage P by inclined plate 24 and upper-part member 25. FIG. 6 indicates how medicine M is guided two by two into each passage P.

When rotating member 20 rotates and passage P comes near discharge port 11*b* in this state, inner-side plate 14*b* enters between medicine M, which is the lowermost, and medicine M, which is thereon, of medicines M within passage P. At this time, medicine M, which is the lowermost, is on bottom part 11*a*, and other medicines M are directly or indirectly on inner-side plate 14*b*. Further, when rotating member 20 rotates and passage P comes above discharge port 11*b*, only medicine M, which is the lowermost, falls downward from bottom part 11*a* through discharge port 11*b*.

Accordingly, the medicine supply device is capable of supplying medicines M one by one to a desired position, for example, a medicine packer by rotating rotating member 20 provided in medicine case 1. In addition, medicine case 1 according to the present embodiment makes it possible to adjust the width and depth of passage P steplessly without replacing members. Accordingly, medicine case 1 according to the present embodiment is capable of handling various kinds of medicines M.

Although medicine case 1 and the medicine supply device including medicine case 1 according to the embodiment have been described thus far, it is needless to say that medicine case 1 according to the present invention is not limited to what has been described so far.

For example, in a case where only one medicine M can enter passage P physically, partition member 14 may be attached to an upper side of passage P. In this case, slot S may not be formed in first side wall member 21, second side wall member 22, and third side wall member 23.

Further, in a case where each of a plurality of kinds of medicines M has a common thickness, it is not necessary to set the depth of passage P. Accordingly, in this case, third side wall member 23 may be dispensed with. Similarly, inclined plate 24 may also be dispensed with.

Further, since inclined plate 24 is exposed above rotating member 20, position adjustment thereof can be relatively easily performed. Accordingly, it may be configured such that the position adjustment thereof can be performed by not connecting inclined plate 24 and third side wall member 23 by connecting rod 26, but by causing inclined plate 24 and third side wall member 23 to advance or retract independently.

This application is a continuation (in-part) of International Patent Application No. PCT/JP2020/001358, filed on Jan. 16, 2020, the disclosure of which is incorporated herein by reference in its entirety. International Patent Application No. PCT/JP2020/001358 is entitled to (or claims) the benefit of Japanese Patent Application No. 2019-029743, filed on Feb. 21, 2019, the disclosure of which is incorporated herein by reference in its entirety.

INDUSTRIAL APPLICABILITY

The present invention can be suitably applied to a medicine case for discharging medicines such as tablets and capsules one by one, and a medicine supply device including such a medicine case.

REFERENCE SIGNS LIST

1 Medicine case
11 Case body
11*a* Bottom part
11*b* Discharge port
11*c* Driving shaft insertion port
12 Lid
13 Side lid
13*a* Partition member insertion port
14 Partition member
14*a* Outer-side plate
14*b* Inner-side plate
15 Screw
16 Screw hole
20 Rotating member
21 First side wall member
21*a* First side wall member body
21*b* First rack
21*c* First fall prevention member
22 Second side wall member
22*a* Second side wall member body
22*b* Second rack
22*c* Second fall prevention member
23 Third side wall member
23*a* Third side wall member body
23*b* Third rack
23*c* Guide rod
24 Inclined plate
25 Upper-part member
25*a* Guide part
26 Connecting rod
30 Base part
31 Shaft
32 Branch member
33 Side wall support member
34 Gear support member
40 Central gear
41 First gear
42 Second gear
43 Third gear
P Passage
S Slot
M Medicine

The invention claimed is:

1. A medicine case, comprising:

a case body that accommodates a medicine, wherein the case body includes a bottom part and a discharge port for the medicine is provided in the bottom part; and a rotating member disposed inside the case body, the rotating member rotating about a rotating shaft, wherein:

the rotating member includes a first side wall member and a second side wall member that are parallel to each other, wherein the first sidewall member and the second sidewall member form a passage and the medicine is guided to the discharge port through the passage, and the first side wall member and the second side wall member are movable so as to approach and separate from each other while being maintained parallel to each to adjust a width of the passage.

2. The medicine case according to claim 1, wherein the second side wall member has a shape that is a mirror image of a shape of the first side wall member.

3. The medicine case according to claim 1, further comprising a partition member, wherein:

an attachment position of the partition member is changeable and the partition member is enterable into the passage, each of the first side wall member and the second side wall member includes a plurality of slots, wherein the partition member passes through one of the plurality of slots, when the rotating member rotates, and the partition member defines a partition position in the passage, and the partition position is adjusted by changing the attachment position of the partition member.

4. The medicine case according to claim 3, wherein:

the rotating member further includes a third side wall member disposed between the first side wall member and the second side wall member, and the third side wall member is configured to advance and retract in a radial direction of the rotating member to adjust a depth of the passage.

5. The medicine case according to claim 4, wherein:

the rotating member further includes an inclined plate disposed in an upper part of the rotating member, and the inclined plate is configured to advance and retract along an extending direction of the inclined plate to adjust a depth of an inlet of the passage.

6. The medicine case according to claim 5, wherein the inclined plate is connected to the third side wall member and advances and retracts in conjunction with advance and retraction of the third side wall member.

7. The medicine case according to claim 4, wherein the third side wall member includes a plurality of slots, wherein partition member passes through the plurality of slots when the third side wall member is located on an outer side in the radial direction of the rotating member in the rotating member.

8. The medicine case according to claim 1, wherein when the first side wall member and the second side wall member approach or separate from each other while being maintained parallel to each other, the first side wall member and the second side wall member linearly move along a direction inclined with respect to a direction orthogonal to a radial direction of the rotating member which is parallel to an extending direction of the first side wall member and the second side wall member.

9. A medicine supply device, comprising the medicine case according claim 1.

* * * * *